US006684423B2

(12) United States Patent
Godette

(10) Patent No.: US 6,684,423 B2
(45) Date of Patent: Feb. 3, 2004

(54) MASSAGE MOTOR MOUNTING FOR BED/CHAIR

(75) Inventor: Robert G. Godette, Midway City, CA (US)

(73) Assignee: L&P Property Management Company, South Gate, CA (US)

( * ) Notice: Subject to any disclaimer, the term of this patent is extended or adjusted under 35 U.S.C. 154(b) by 36 days.

(21) Appl. No.: 09/747,870

(22) Filed: Dec. 22, 2000

(65) Prior Publication Data

US 2002/0078503 A1 Jun. 27, 2002

(51) Int. Cl.[7] ..... A46B 7/02
(52) U.S. Cl. ..... 5/600; 5/933; 5/617
(58) Field of Search ..... 5/600, 613, 617, 5/618, 933; 601/84, 85, 87, 89, 90, 91

(56) References Cited

U.S. PATENT DOCUMENTS 5,007,410 A * 4/1991 DeLaney ..... 5/694
6,209,157 B1 * 4/2001 Hensley ..... 5/613

* cited by examiner

*Primary Examiner*—Teri Pham Luu
*Assistant Examiner*—Fredrick Conley
(74) *Attorney, Agent, or Firm*—Wood, Herron & Evans, L.L.P.

(57) ABSTRACT

An adjustable bed having a bed frame and a center support section supported by the bed frame. A second support section has one end pivotally attached to one end of the center support section, and the second support section has an opening therethrough. A massage motor assembly has a housing mounted to the second support section over the opening. A massage motor is disposed in the housing, and a resilient material is disposed in the housing between the massage motor and the housing. Enclosing the massage motor in the resilient material reduces its operational noise and permits the massage motor to move in its natural orbital motion.

14 Claims, 2 Drawing Sheets

MASSAGE MOTOR MOUNTING FOR BED/CHAIR

FIELD OF THE INVENTION

This invention relates generally to beds and more particularly, to improvements to beds having massage motors.

BACKGROUND OF THE INVENTION

Adjustable beds were originally designed principally for use by patients who had to spend long periods of time in bed for reasons of health, injury, etc. However, more recently, adjustable beds are being used in residential environments by users who have no health or physical impairment. An increasing number of people place televisions and other entertainment devices in the bedroom, and more time is spent lounging in bed. Hence, the bed, and in particular, an adjustable bed, is considered by many users an alternative piece of leisure furniture.

One recent development in adjustable beds is the development of a "wallhugger" adjustable bed. The wallhugger adjustable bed maintains the user in the same position with respect to adjacent appliances and furniture as the head portion of the bed is moved between flat and elevated positions. As the market for leisure beds grows, there is a continuing effort by suppliers to provide leisure beds that are more comfortable, have more options, for example, massage capabilities, more sophisticated controls, and are more affordable.

Almost all adjustable beds utilize one or more massage motors which are controllable by a user to provide a massaging action to the user. In one embodiment, a massage motor is rigidly connected to an underside of a rigid platform, for example, a head board or a foot board, that is hinged to a center board or platform. Further, the whole articulated platform normally supports a mattress base, for example, a foam pad, over which is placed a mattress. Thus, any vibration applied to the underside of the head board must vibrate the whole head board; and further, the vibration is partially absorbed and attenuated by the soft materials in the mattress base and the mattress. The resulting or net vibration applied to a user lying on the mattress is often substantially less than desired. Further, with such a massage motor mounting, the noise caused by the massage motor operation can be objectionable.

In other designs, the mattress base is a foam pad approximately 4 inches thick; and the massage motor is inserted into a slit, so that it is fully contained within the mattress base. While such a design is relatively quiet, the massage action of the massage motor is attenuated by the relatively thick foam of the mattress base.

Thus, there is a need for an improved structure for more effectively mounting a massage motor that provides a more desirable and penetrating massaging action to a user lying on the bed.

SUMMARY OF THE INVENTION

The present invention provides a bed having a quieter operation and an improved massage capability, thereby increasing the satisfaction of the user with the bed. The massage motor mounting of the present invention is especially useful on beds having a relatively thin mattress base. Further, the massage motor mounting of the present invention is less expensive than known massage motor mountings for beds having a thin mattress base.

According to the principles of the present invention and in accordance with one embodiment, the present invention provides an adjustable bed having a bed frame and a center support section supported by the bed frame. A second support section has one end pivotally attached to one end of the center support section, and the second support section has an opening therethrough. A massage motor assembly has a housing mounted to the second support section over the opening. A massage motor is disposed in the housing, and a resilient material is disposed in the housing between the massage motor and the housing.

Enclosing the massage motor with the resilient material substantially reduces the operational noise of the massage motor. Further, the massage motor is able to move in its orbital motion within the housing and into the opening in the second support section, thereby imparting an effective massage action to the user. In addition, the mounting of the massage motor assembly does not in any way adversely impact the feel of the bed to a very heavy user.

In accordance with one aspect of the invention, the resilient material is a flexible foam material which adds very little cost to the massage motor assembly.

These and other objects and advantages of the present invention will become more readily apparent during the following detailed description taken in conjunction with the drawings herein.

DETAILED DESCRIPTION OF THE INVENTION

Figure 1:
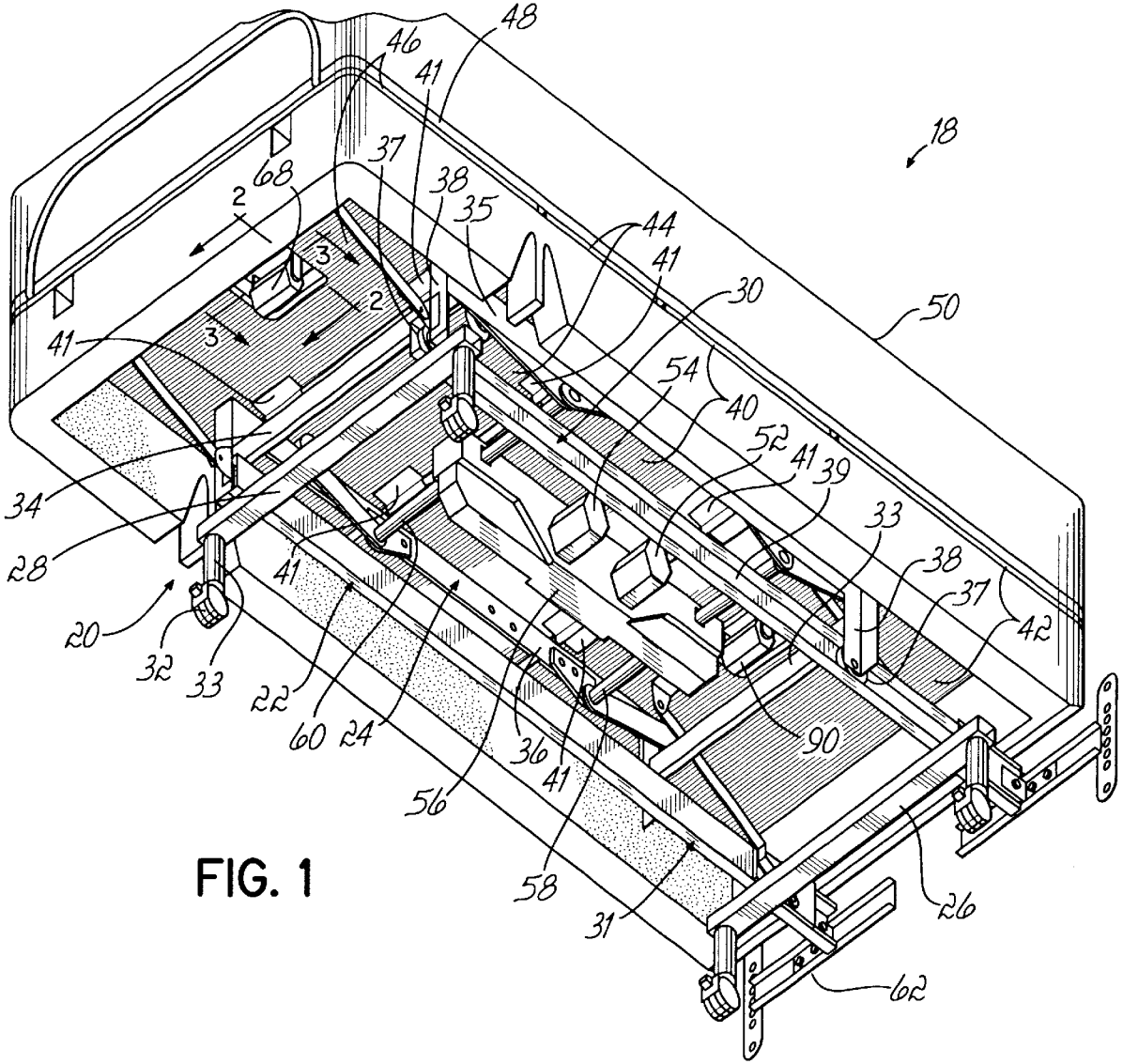
FIG. 1 a perspective view of an adjustable bed having a massage motor mounted in accordance with the principles of the present invention.

Referring to FIG. 1, an adjustable bed 18 includes a bed frame 20 comprised of a lower frame 22 and an upper frame 24 movably mounted on the lower frame 22. The lower frame 22 has head and foot end rails 26, 28, respectively, and left and right side rails 30, 31, respectively. The rails 26–31 are joined at their ends to form a generally rectangular frame section. Each of the casters 32 includes a caster bracket 33 for receiving the stem of the caster (not shown) that supports the adjustable bed 18 on the floor. The upper frame 24 includes a head rail 33, a foot rail 34 and left and right side rails 35, 36, respectively. The rails 33–36 are rigidly connected at their ends with fasteners to form the generally rectangular upper frame 24. The upper frame side rails 35–36 are made of angle stock, and the upper frame 24 is movably mounted on the lower frame 22 by four wheels 37 which are rotatably mounted to the ends of legs 38. The wheels 37 ride in C-shaped channels or tracks 39 forming the left and right lower frame side rails 30, 31, respectively.

In a known manner, a center support board or platform 40 is connected to the upper frame 24, and a head support board or platform 42 is pivotally connected to a head end of the center supporting platform 40 with hinges 41. A thigh support board or platform 44 is pivotally connected to a foot end of the center support platform 40 by hinges 41; and a foot supporting board or platform 46 is pivotally connected to a foot end of the thigh supporting platform 42 by hinges 41. The supporting platforms 40–46 may be made from any desired material that is capable of properly supporting a user on a mattress, for example, a plywood or OSB material. The supporting platforms 40–46 are normally 0.625 inch thick but may be other thicknesses as is required. A mattress base 48, for example, a one inch foam pad, is mounted over and covers the head, center, thigh and foot support boards 40–46. Normally, the boards 40–46 and mattress base 48 are enclosed within a covering (not shown). A mattress 50 is then laid over the mattress base 48.

Head and thigh motors 52, 54, respectively, are mounted to a drive assembly 56 which mechanically couples the head and thigh motors 52, 54 to respective head and thigh torque tubes 58, 60 in a known manner. Operating the head motor 52 rotates the torque tube 58 and raises the head platform 42. With the bed of FIG. 1, as the head platform 42 is raised, the upper frame 24 translates toward the head end the bed; and the head platform 42 remains close to the headboard 117. Operating the thigh motor 54 rotates the thigh torque tube 60 and raises the junction of the thigh and foot platforms 44, 46, respectively.

Figure 2:
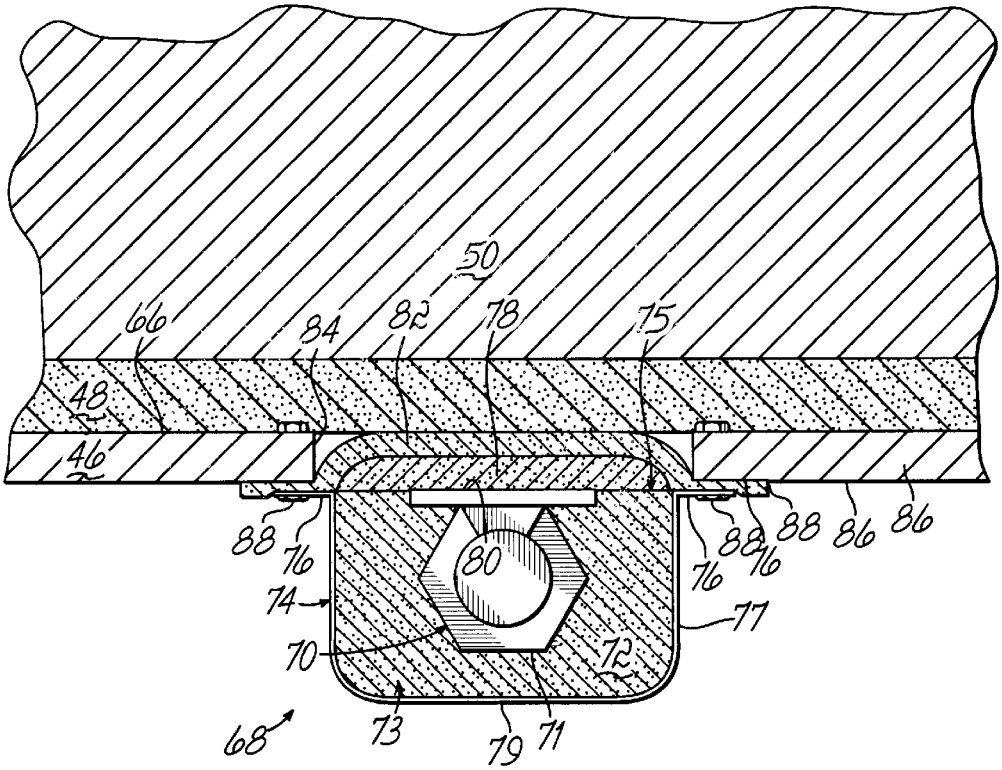
FIG. 2 is a partial cross-sectional view taken along line 2—2 of FIG. 1 and illustrates a massage motor mounting in accordance with the principles of the present invention.
Figure 3:
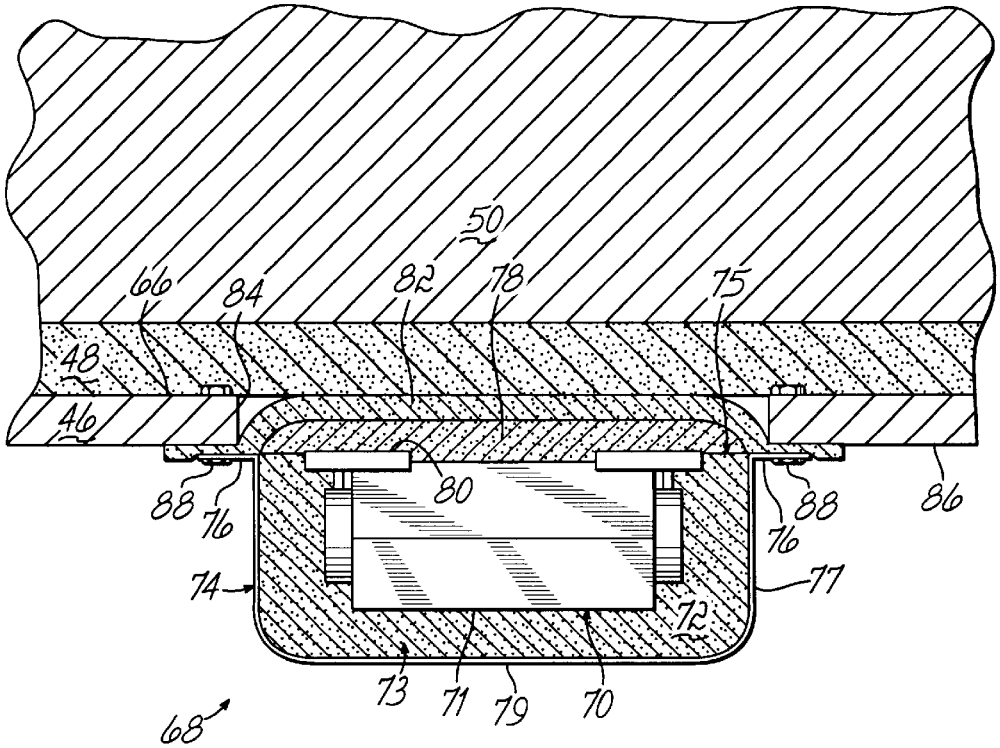
FIG. 3 is a partial cross-sectional view taken along line 3—3 of FIG. 1 and illustrates a massage motor mounting in accordance with the principles of the present invention.

Referring to FIGS. 2 and 3, the mattress base 48 lays over an upper surface 66 of the support platform 46. The mattress base 48 can be made of any soft, flexible material such as a fiber or foam, for example, a fire retardant, urethane foam of about 0.500–3 inches thick, for example, 1 inch thick. The foam mattress base 48 has a typical density of about 1.3–2.3 pounds per cubic foot, for example, 1.8 pounds per cubic foot and a typical I.L.D. of about 30–40 pounds per square inch ("psi"), for example, 35 psi.

The adjustable bed 18 has a massage motor assembly 68 mounted to the foot platform 46. The massage motor assembly 68 includes a massage motor 70 having a massage motor housing 71 surrounded by a foam enclosure or cocoon 73 disposed within an outer housing 74. The massage motor 70 is an electric DC motor that has a light weight, for example, molded plastic motor housing 71, and there are no moving massage motor parts outside the housing motor 71. Massage motors having a heavier metal housing may also be used and are commercially available from Hankscraft of Reedsburg, Wis. More specifically, the outer housing 74 is a generally rectangular enclosure having four sides 77, a top 79 and an upper opening 75. The massage motor housing 71 is fully encased within a first foam inner jacket 72. The assembly of the foam inner jacket 72 and motor 70 is disposed through an opening 75 of the outer housing 74. The outer housing 74 may be made of any rigid material, for example, metal, plastic, etc., that is molded, formed or fabricated to the desired size. The housing includes a mounting flange 76 located on its peripheral edge.

A foam top jacket 78 is placed across the opening 75 of the outer housing 74 and over a bottom side 80 of the massage motor housing 71. A foam pad 82 is placed over the top foam jacket and extends outward over the mounting flange 76. Thus, the housing 71 of the vibrator motor 70 is totally encased by, and floats within, the foam enclosure 73 formed by the respective inner and top jackets 72, 78. The foam inner and top jackets 72, 78 and foam pad 82 can be made of any resilient material, for example, substantially the same flexible foam used for the mattress base 48.

The assembly of the housing 71 of the motor 70, outer housing 74 and foam pad 82 is placed over an opening 84 within the foot platform 46. In that position, the mounting flange 76 compresses a portion of the foam pad 82 a lower surface 86 of the foot platform 46. Fasteners 88 extend through against contiguous holes in the mounting flange 76, foam pad 82 and foot platform 46. The fasteners 88 may be any suitable fastener, for example, a threaded screw or bolt and a mating nut. The fasteners 88 are tightened so that the foam pad 82 provides little, if any, resiliency to the mounting of the massage motor assembly 68 to the foot platform 46.

In FIGS. 2 and 3, the mounting of the massage motor assembly 68 is described with respect to the foot platform 46. As will be appreciated, the massage motor assembly 90 (FIG. 1) and its mounting with respect to the head platform 40 is identical to that described with respect to massage motor assembly 68 in FIGS. 2 and 3. Thus, one or more massage motor assemblies 68 as illustrated in FIGS. 2 and 3 may be used with respect to any of the bed platform sections 40–46.

In use, the mattress base 48 functions to dampen the feeling of the irregularities on the top surface 66 (FIGS. 2 and 3) caused by fasteners, for example, fasteners 88 and the fasteners used to connect the hinges 41 (FIG. 1) to the supporting platforms 40–46. As shown in FIGS. 2 and 3, when the vibrator motor 70 is turned off, the massage motor 70 is principally below the platform 46 and outside the opening 84. When the message motor 70 is turned on, the whole motor 70 including the massage motor housing 71 is able to move in its orbital motion within the foam enclosure 73. The foam enclosure 73 functions first to attenuate the noise of the vibrating motor 70. Further, the foam enclosure 73 can also attenuate the vibrating action of the motor 70 and change the "feel" of the massaging action imparted by the motor 70. Thus, the degree of noise attenuation and "feel" of the massaging action can be tuned by using foams in the enclosure 73 of different densities. Being placed over the opening 84 in the foot platform 46, as the motor 70 moves through its orbital motion, it moves partially into the opening 84 within the platform 46. Such motion is effective to transfer a massaging action to a user lying on the mattress 50.

The massage motor mounting of the present invention provides numerous advantages. First, the operation of the massage motor 70 is very quiet. Second, the massage motor assembly 68 can be used with a relatively thin, for example, one inch thick, mattress base 48. Third, the massage motor assembly 68 permits the massage motor to move through its orbital motion, and a very effective, penetrating massage action is transferred to the user.

While the invention has been illustrated by the description of one embodiment and while the embodiment has been described in considerable detail, there is no intention to restrict nor in any way limit the scope of the appended claims to such detail. Additional advantages and modifications will readily appear to those who are skilled in the art. For example, the massage motor assembly 68 of FIGS. 2 and 3 are described with respect to a "wallhugger" adjustable bed. As will be appreciated, the same massage motor assembly 68 may be applied to other adjustable bed designs as well as nonadjustable bed designs. Further, the massage motor assembly 68 may also be used with recliner chairs and couches as well as other leisure furniture.

Therefore, the invention in its broadest aspects is not limited to the specific detail shown and described. Consequently, departures may be made from the details described herein without departing from the spirit and scope of the claims which follow.

What is claimed is:

1. An adjustable bed comprising:

a bed frame;

a rigid center support section supported by the bed frame;

a rigid second support section having one end pivotally attached to one end of the rigid center support section, the rigid second support section having an opening extending therethrough between upper and lower sides;

a layer of flexible material disposed on upper sides of the rigid center support section and the rigid second support section; and a massage motor assembly comprising an outer housing mounted to the lower side of the rigid second support section, the outer housing having an opening contiguous with the opening on the lower side of the rigid second support section, a massage motor having a massage motor housing disposed in the outer housing, there being no moving massage motor parts outside the massage motor housing, and a resilient material disposed in the outer housing between the massage motor housing and the outer housing, the massage motor housing not directly contacting either the outer housing or the rigid second support section, the resilient material reducing an operational noise of the massage motor.

2. The adjustable bed of claim 1 wherein the massage motor being capable of moving through an orbital motion within the outer housing and further, the massage motor capable of moving into the opening of the second support section, thereby imparting a massaging action to the user.

3. The adjustable bed of claim 1 further comprising a mattress base having a thickness of approximately one inch covering the center and second support sections.

4. The adjustable bed of claim 1 wherein the resilient material comprises a resilient inner jacket disposed around the massage motor housing within the outer housing.

5. The adjustable bed of claim 4 wherein the outer housing has an opening for receiving the inner jacket and massage motor.

6. The adjustable bed of claim 5 wherein the resilient material further comprises a resilient top jacket disposed within the opening in the outer housing and covering the massage motor housing.

7. The adjustable bed of claim 6 wherein the outer housing further comprises a mounting flange at a periphery of the outer housing for mounting the outer housing to the lower side of the second support member.

8. The adjustable bed of claim 7 wherein the resilient material further comprises a resilient pad extending over the opening of the outer housing and between the mounting flange and the lower side of the second support member, the attachment of the mounting flange to the lower side of the second support member holding the resilient pad in place.

9. The adjustable bed of claim 8 wherein the resilient inner jacket, the resilient top jacket and the resilient pad is a foam material.

10. The adjustable bed of claim 1 wherein the second support section comprises:

a rigid thigh support section having one end pivotally connected to the opposite end of the center support section; and a rigid foot support section having one end pivotally connected to an opposite end of the thigh center support section and the opening extends between upper and lower sides of the foot support section, the massage motor assembly being mounted to the lower side of the foot support section.

11. The adjustable bed of claim 1 wherein the second support section is a head support section and the opening extends between upper and lower sides of the head support section, the massage motor assembly being mounted to the lower side of the head support section.

12. The adjustable bed of claim 1 further comprising:

a rigid thigh support section having one end pivotally connected to the opposite end of the center support section;

a rigid foot support section having one end pivotally connected to an opposite end of the thigh support section, the foot support section having an opening extending therethrough between upper and lower sides; and a second massage motor assembly comprising a second outer housing mounted to the lower side of the foot support section over the opening of the foot support section, a second massage motor having a second massage motor housing disposed in the outer housing, there being no moving massage motor parts outside the second massage motor housing, and a resilient material disposed in the outer housing between the second massage motor housing and the outer housing, the second massage motor housing not directly contacting either the outer housing or the foot support section, the resilient material reducing an operational noise of the second massage motor.

13. A bed comprising:

a bed frame;

a rigid support section having an opening extending therethrough between upper and lower sides;

a layer of flexible material disposed on an upper side of the rigid support section: and a massage motor assembly comprising an outer housing mounted to the lower side of the rigid support section, the outer housing having an opening contiguous with the opening on the lower side of the rigid support section, a massage motor having a massage motor housing disposed in the outer housing, there being no moving massage motor parts outside the massage motor housing, and a resilient material disposed in the outer housing between the massage motor housing and the outer housing, the massage motor housing not directly contacting either the outer housing or the support section, the resilient material reducing an operational noise of the massage motor.

14. The bed of claim 13 further comprising a mattress base having a thickness of approximately one inch covering the support section.

* * * * *

UNITED STATES PATENT AND TRADEMARK OFFICE

CERTIFICATE OF CORRECTION

PATENT NO. : 6,684,423 B2
DATED : February 3, 2004
INVENTOR(S) : Robert G. Godette It is certified that error appears in the above-identified patent and that said Letters Patent is hereby corrected as shown below:

Column 2,
Line 30, “Fig. 1 a perspective” should read -- Fig. 1 is a perspective --.

Column 3,
Line 18, “head end the bed” should read -- head end of the bed --.
Line 66, “pad 82 a lower” should read -- pad 82 against a lower --.

Column 4,
Line 1, “through against contiguous” should read -- through contiguous --.
Line 53, “restrict nor in any way” should read -- restrict or in any way --.
Line 57, “are described” should read -- is described --.

Column 5,
Line 57, “the resilient pad is” should read -- the resilient pad are --.

Signed and Sealed this

Eighteenth Day of May, 2004

JON W. DUDAS
*Acting Director of the United States Patent and Trademark Office*